United States Patent [19]

Sovis et al.

[11] Patent Number: 4,959,885

[45] Date of Patent: Oct. 2, 1990

[54] VACUUM CLEANER

[75] Inventors: John F. Sovis, Twinsburg; Craig M. Saunders, Rocky River; James J. Kopco, Richmond Heights; Michael F. Wright, Cuyahoga Falls, all of Ohio

[73] Assignee: Royal Applicance Mfg. Co., Cleveland, Ohio

[21] Appl. No.: 464,203

[22] Filed: Jan. 12, 1990

[51] Int. Cl.[5] ..... A47L 5/32

[52] U.S. Cl. ..... 15/335; 15/323; 15/350; 15/412; 15/416

[58] Field of Search ..... 15/331, 334, 335, 412, 15/350, 351, 416

[56] References Cited

U.S. PATENT DOCUMENTS

| | | | |
|---|---|---|---|
| 2,300,266 | 10/1942 | Smellie | 15/350 X |
| 2,348,861 | 5/1944 | Smellie | 15/416 X |
| 2,633,596 | 4/1953 | Turner et al. | 15/350 X |
| 2,763,887 | 9/1956 | Brace | 15/361 |
| 2,876,481 | 3/1959 | Gerber et al. | 15/331 |
| 2,898,621 | 8/1959 | Vance | 15/334 X |
| 2,898,622 | 8/1959 | Hurd | 15/334 X |
| 3,634,905 | 1/1972 | Boyd | 15/412 X |
| 3,675,268 | 7/1972 | Nordeen | 15/350 |
| 3,942,219 | 3/1976 | Johnson | 15/416 X |
| 4,171,553 | 10/1979 | Stein | 15/350 |
| 4,217,674 | 8/1980 | Hayashi et al. | 15/361 |
| 4,446,594 | 5/1984 | Watanabe et al. | 15/323 |
| 4,517,705 | 5/1985 | Hug | 15/351 |
| 4,686,736 | 8/1987 | Petralia et al. | 15/332 |
| 4,761,850 | 8/1988 | Romeo et al. | 15/323 |

*Primary Examiner*—Chris K. Moore

*Attorney, Agent, or Firm*—Fay, Sharpe, Beall, Fagan, Minnich & McKee

[57] ABSTRACT

A convertible vacuum cleaner includes a nozzle base and a motor and filter housing rotatably mounted on the nozzle base. The nozzle base is movable along a floor surface and includes a brush cleaner for mounting a rotatable brush and a first suction passage communicating with the brush chamber at one end and with an exterior periphery of the nozzle base at the other end. The motor and filter housing includes a second suction passage communicating at a first end with the first suction passage second end and at a second end with an exterior periphery of the motor and filter housing. The motor chamber is formed in the motor and filter housing in spaced relation to the second suction passage. A suction chamber is disposed in the motor and filter housing in a spaced manner from the second suction passage and the motor chamber. The suction chamber has an inlet port communicating with the exterior periphery of the motor and filter housing. A flexible hose is mounted outside the motor and filter housing, the hose having a first end communicating with the second suction passage second end and a second end communicating with the suction chamber inlet port. The flexible hose first end can be selectively removed from communication with the second suction passage to enable the vacuum cleaner to be used with associated cleaning tools.

20 Claims, 4 Drawing Sheets

140
142
134
130
128
132
144
124
A
146
120
122
148
146
162
60
156
166
106
150
152
126
158
154
105
70
160
164
168
94
91
90
111
162
33
10
28
34
92
112
32
24
30
114
68
88
110
14
12
26
18
40
66
16

VACUUM CLEANER

BACKGROUND OF THE INVENTION

The present invention relates to vacuum cleaners. More particularly, the instant invention relates to improvements in convertible vacuum cleaners having the combined features of upright and canister vacuum cleaners.

Convertible vacuum cleaners which embody the advantages of both an upright and a canister vacuum cleaner have recently come into vogue. Such a vacuum cleaner may be used as an upright cleaner for the cleaning of a floor surface such as a carpet or as a canister-type vacuum cleaner for general purpose cleaning such as of upholstered furniture, draperies and the like. For the latter purpose, a separate nozzle can be attached to a hose end pulled out of a vacuum cleaner socket. For floor cleaning, the hose end is inserted in the socket to allow a suction to be drawn on the floor surface. All the parts necessary for the use of the cleaner for both types of operation are associated with the cleaner except the separate nozzles which are to be attached to the end of the hose when the cleaner is used for general cleaning purposes.

Some designs of such a convertible vacuum cleaner are disadvantageous in that different motors are utilized to drive the fan or air pump which creates the vacuum and to drive the brush which agitates the floor surface during floor cleaning operations.

Several conventional vacuum cleaners do utilize the same motor to drive both the suction fan as well as the rotating brush. However, these types of vacuum cleaners have a complicated design which is difficult and expensive to manufacture. Also, in these vacuum cleaners the nozzles which are to be attached to the end of the hose are stored separately from the vacuum cleaner.

One type of known vacuum cleaner utilizes a single motor to both drive the fan or air pump and the rotating brush and holds the nozzles used for general cleaning purposes on the vacuum cleaner body itself. However, this known vacuum cleaner is disadvantageous in that it has a complicated design which is difficult to manufacture and includes a plurality of parts making the vacuum cleaner relatively expensive.

Accordingly, it has been considered desirable to develop a new and improved convertible vacuum cleaner which would overcome the foregoing difficulties and others and meet the above-stated needs while providing better and more advantageous overall results.

BRIEF SUMMARY OF THE INVENTION

In accordance with the present invention, a convertible vacuum cleaner is provided.

More particularly in accordance with this aspect of the invention, the vacuum cleaner comprises a nozzle base movable along the floor surface and including-a brush chamber for mounting a rotatable brush and a first suction passage communicating with the brush chamber at one end and with an exterior periphery of the nozzle base at the other end. A motor and filter housing is rotatably mounted on the nozzle base. The housing comprises a second suction passage communicating at a first end with the first suction passage second end and at a second end with an exterior periphery of the motor and filter housing. A motor chamber is formed in the motor and filter housing in spaced relation to the second suction passage. A suction chamber is disposed in the motor and filter housing in a spaced manner from the second suction passage and the motor chamber. The suction chamber has an inlet port communicating with the exterior periphery of the motor and filter housing. A flexible hose is mounted outside the motor and filter housing. The hose has a first end communicating with the second suction passage second end and a second end communicating with the suction chamber inlet port. The flexible hose first end can be selectively removed from communicating with the second suction passage to enable the vacuum cleaner to be used with associated cleaning tools.

According to another aspect of the invention, a combination upright and canister-type vacuum cleaner is disclosed.

More particularly in accordance with this aspect of the invention, the vacuum cleaner comprises a nozzle base movable along a floor surface and including a brush chamber for mounting a rotatable brush in a first suction passage communicating with the brush chamber at one end and with an exterior periphery of the nozzle base at the other end. A motor and filter housing is rotatably mounted on the nozzle base. The housing comprises a first motor shell and a second motor shell with the two motor shells cooperating to define a motor chamber and a second suction passage which is spaced from the motor chamber to preclude communication therebetween. The second suction passage communicates at a first end with the first suction passage second end and at a second end with an exterior periphery of the motor and filter housing. A motor is positioned in the motor chamber. The motor and filter housing further comprises a filter back housing located adjacent the first and second motor shells. The filter bag housing has an exterior periphery and a suction chamber is disposed therein. The suction chamber has an inlet port communicating with the exterior periphery of the filter back housing. A filter bag is located in the suction chamber. Also provided is a wand having a first end which is selectively secured to the second suction passage second end and a second end. A flexible hose is mounted outside the motor and filter housing. The hose has a first end communicating with the wand second end and a second end communicating with the suction chamber inlet port. The wand can be selectively disconnected from the suction passage second end to enable the vacuum cleaner to be used with associated cleaning tools.

According to a further aspect of the invention, a convertible vacuum cleaner which can be used both for cleaning a floor surface and for above the floor cleaning operations is provided.

More particularly in accordance with this aspect of the invention, the vacuum cleaner comprises a nozzle housing movable along a floor surface and including a brush chamber for mounting a rotatable brush and a first suction passage communicating with the brush chamber at one end and with an exterior periphery of the nozzle base at the other end. The nozzle housing further includes a substantially semi-circular chamber which has, on opposed sides thereof, first and second flanged sections respectively. A motor and filter housing having a substantially barrel shaped lower periphery is rotatably mounted in the nozzle housing chamber. The motor and filter housing comprises a first motor shell having a flanged first end and a flanged second end and a second motor shell having a flanged first end and a flanged second end. The first and second motor shells cooperate to define a motor chamber and a second suction passage which is spaced from the motor chamber to preclude communication therebetween. The second suction passage communicates at a first end with the first suction passage and at the second end with an exterior periphery of the motor and filter housing. A first means is provided for securing the first and second motor shell flanged first ends to the nozzle housing first flanged section and for providing a first pivot point of the motor and filter housing on the nozzle housing. A second means secures the first and second motor shell flanged second ends together and provides a second pivot point of the motor and filter housing on the nozzle housing. The second suction passage first end terminates at the first and second motor shell flanged second ends and communicates with the first suction passage second end which is defined in a mating shell portion of the nozzle housing. The motor and filter housing further comprises a filter bag housing in which is defined a suction chamber. The suction chamber is disposed in a spaced manner from the second suction passage and the motor chamber. The suction chamber has an inlet port communicating the exterior periphery of the filter bag housing. A wand is provided having a first end selectively secured to the second suction passage and a second end. A flexible hose is mounted outside the motor and filter housing. The hose has a first end communicating with the wand second end and a second end communicating with the suction chamber inlet port. The wand can be selectively disconnected from the suction passage second end to enable the vacuum cleaner to be used with associated cleaning tools.

One advantage of the present invention is the provision of a new and improved convertible vacuum cleaner.

Another advantage of the present invention is the provision of an improved vacuum cleaner which combines the features of an upright and a canister vacuum cleaner.

Still another advantage of the present invention is the provision of a convertible vacuum cleaner which is low in cost and easy to manufacture but is sturdy and capable of withstanding prolonged use.

Yet another advantage of the present invention is the provision of a convertible vacuum cleaner which affords both floor cleaning operations, with the aid of a rotating brush, as well as above the floor cleaning operations and which uses the same motor for creating the vacuum and for driving the brush.

Yet still another advantage of the present invention is the provision of a vacuum cleaner which has an edge cleaning feature.

A further advantage of the present invention is the provision of a vacuum cleaner that is provided with holding means for holding auxiliary cleaning tools, an extra belt and spare filter bags directly on the vacuum cleaner body itself.

A still further advantage of the present invention is the provision of a motor housing which cooperates with a nozzle base to define various suction passages of the vacuum cleaner.

A yet further advantage of the present invention is the provision of a vacuum cleaner in which a suction passage extends through a pivot point between a nozzle base and a motor and filter housing.

Still other benefits and advantages of the invention will become apparent to those skilled in the art upon a reading and understanding of the following detailed specification.

BRIEF DESCRIPTION OF THE DRAWINGS

The invention may take form in certain parts and arrangements of parts, a preferred embodiment of which will be illustrated in the accompanying drawings which form a part hereof and wherein.

DETAILED DESCRIPTION OF THE PREFERRED EMBODIMENT

Figures 1, 4:
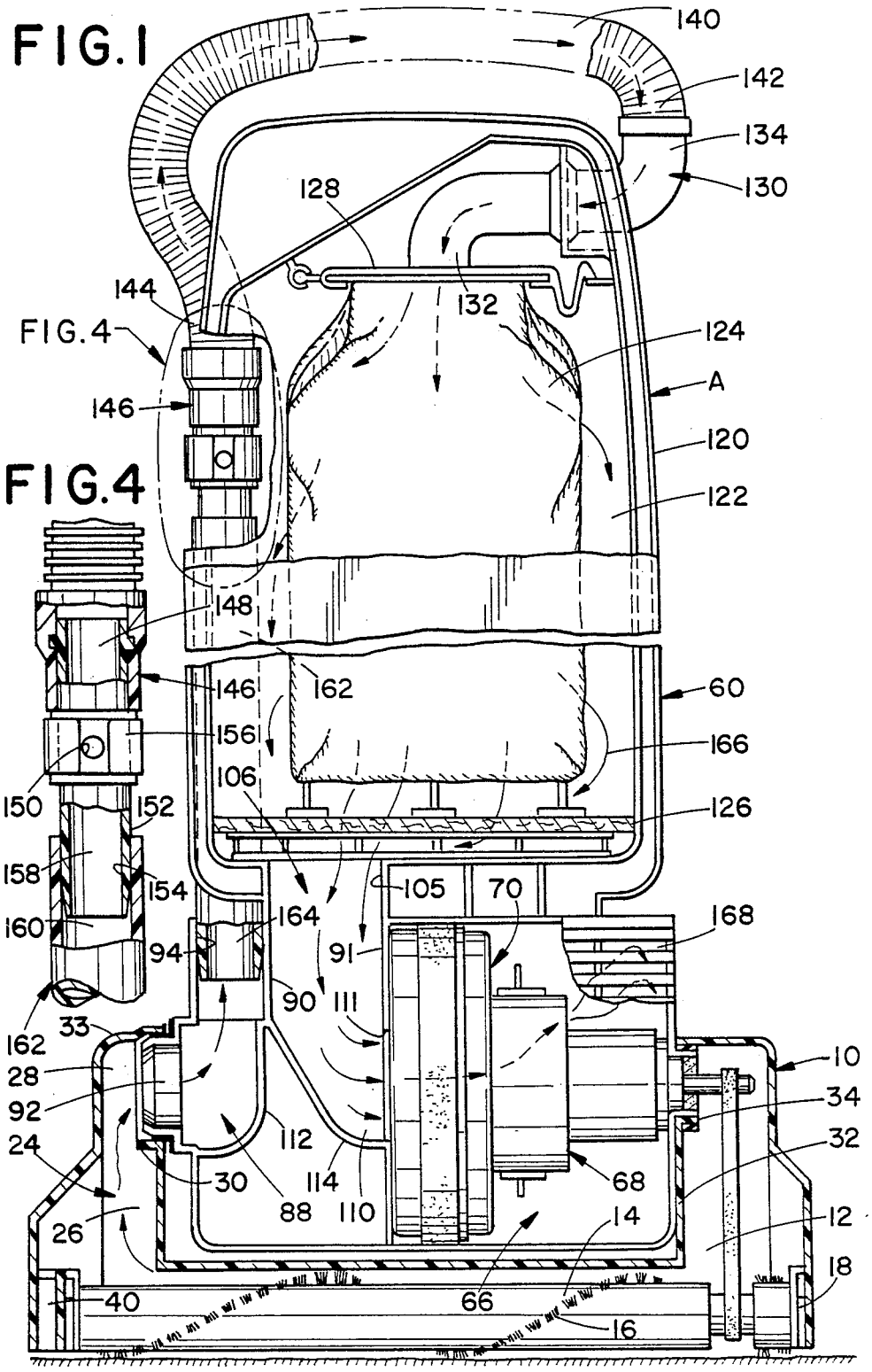
FIG. 1 is a front elevational view, partially in cross-section, of the convertible vacuum cleaner according to the present invention.
FIG. 4 is an enlarged front elevational view, partially in cross-section, of an adaptor and adjacent portions of a hose and a wand of the vacuum cleaner of FIG. 1; and, FIG. 5 is a reduced rear elevational view of the vacuum cleaner of FIG. 1 illustrating its convertibility.

Referring now to the drawings, wherein the showings are for purposes of illustrating a preferred embodiment of the invention only and not for purposes of limiting same, FIG. 1 shows the subject new vacuum cleaner A. While the vacuum cleaner illustrated is primarily designed for and will hereinafter be described in connection with a specific type of convertible vacuum cleaner, it should be appreciated that several of the features disclosed herein can be adapted for use in many different types of convertible vacuum cleaners as well as other types of vacuum cleaners.

The vacuum cleaner A includes a nozzle base 10 containing a brush chamber 12. Mounted in the brush chamber is a rotatable brush 14 having a spiraling series of bristles 16. The brush is mounted on bearings 18 at either end of the brush chamber 12.

Figure 2:
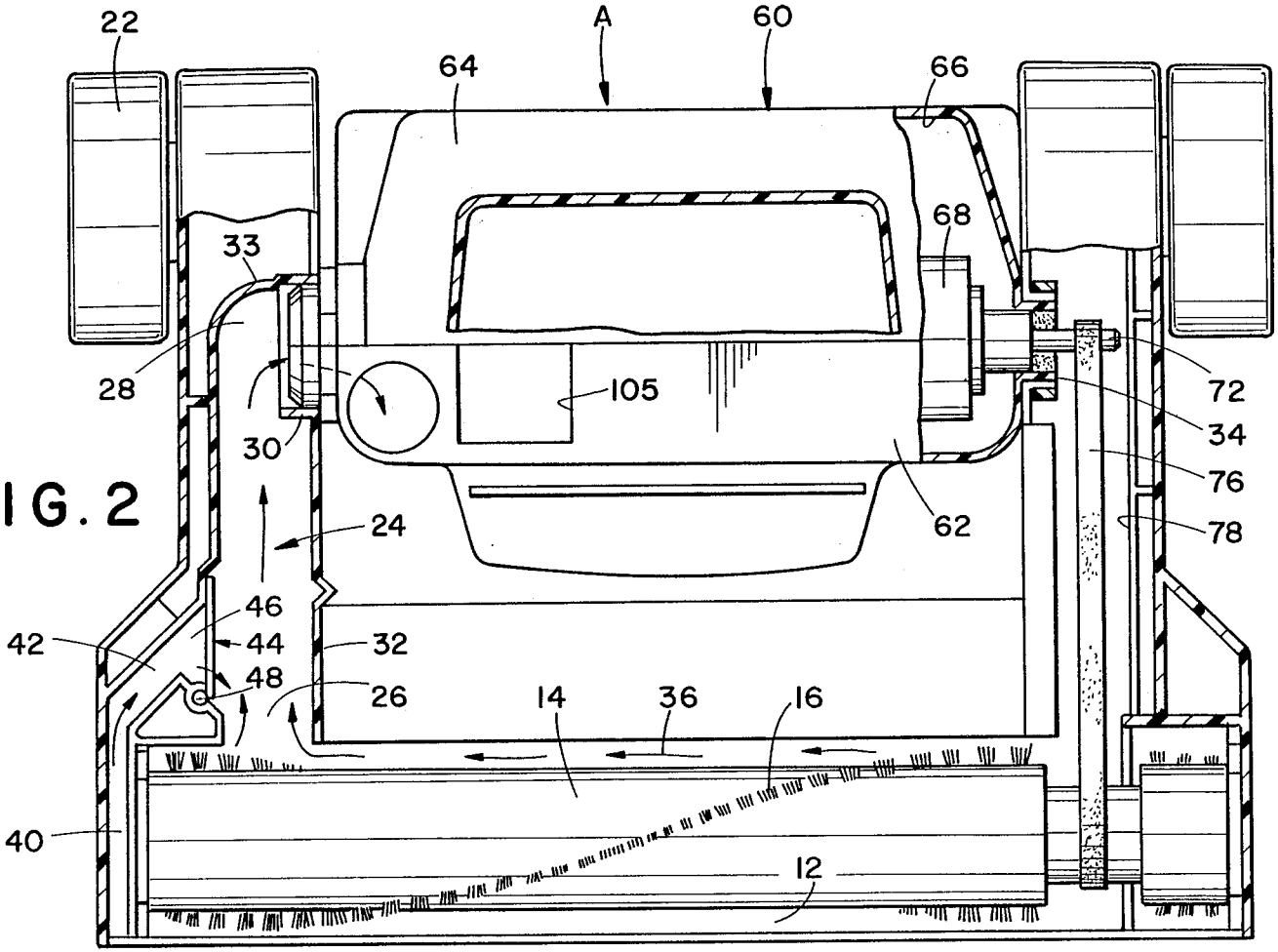
FIG. 2 is a top plan view, partially in cross-section, of the vacuum cleaner of FIG. 1.

With reference now briefly to FIG. 2, mounted on a rear end of the nozzle base 10 are a pair of wheels 22, one on either side of the nozzle base for rotatably supporting the vacuum cleaner. Also provided is a front rotatable support in the way of at least one roller (not visible).

Formed in the nozzle base 10 in a spaced manner from the brush chamber 12, is a first suction passage 24. The first suction passage 24 has a first end 26, which communicates with the brush chamber 12, and a second end 28 which is oriented at right angles to the first end 26. The second end 28 is substantially circular and is composed of a first semi-circular flanged side 30 of a half-cylinder shaped depression 32 defined on a top surface of the nozzle base 10 and a semi-circular portion of an outer shell 33 of the nozzle base 10. The half-cylinder shaped depression 32 defined on the nozzle base also has a semi-circular flanged second side 34.

With reference now to FIG. 2, the rotatable brush 14 moves in a counterclockwise direction when viewed from the left side of the vacuum cleaner A. The spiral path formed by the bristles 16 acts as a conveyor to move the dirt-laden air, which has been agitated away from the floor surface, in the direction of arrows 36 and to the first suction passage first end 26.

Provided adjacent the brush chamber 12 is a side suction chamber 40 which enables the vacuum cleaner A to be used for edge cleaning. Leading from the chamber 40 is a passage 42 defined in the housing 10 which passage leads into the first suction passage 24. Controlling the movement of air through the passage 42 is a valve means 44 which comprises an arm 46 that is pivoted around a pivot point 48. A suitable control means (not illustrated) is provided on the exterior of the nozzle base so as to enable manual control of the valve means 44 simply by a pivoting of the arm 46 around pivot point 48. The movable flap or arm 46 enables the suction drawn by the vacuum cleaner to be directed either to the side edge 40 or to the brush chamber 12, as desired.

Figure 3:
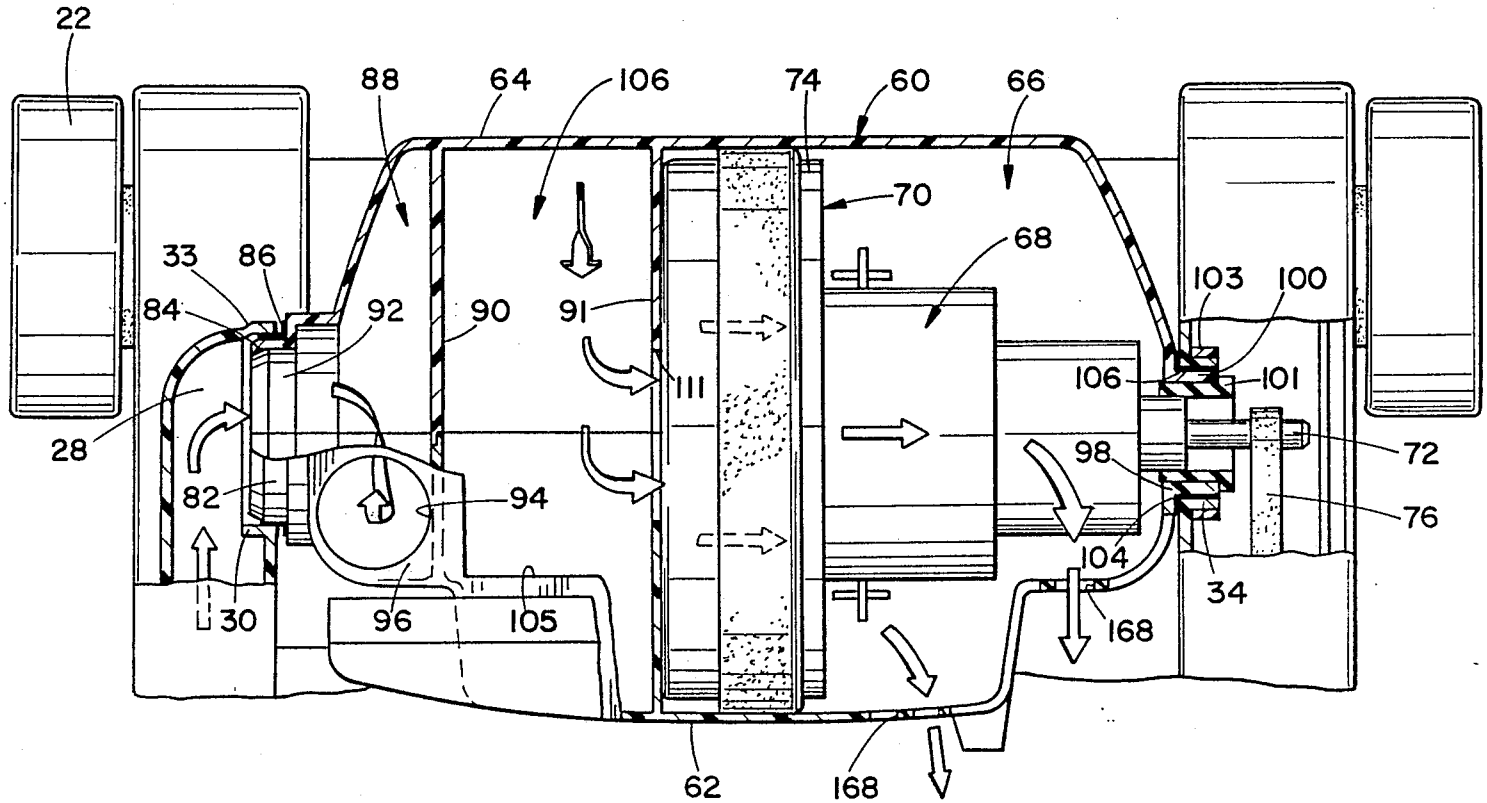
FIG. 3 is an enlarged cross-sectional view of a motor housing portion of the vacuum cleaner of FIG. 2.

Rotatably mounted on the nozzle base 10 is a motor and filter housing 60 having a substantially barrel shaped lower periphery adapted to be mounted in said half-cylinder shaped depression 32 of the nozzle base 10. With reference now to FIG. 3, the barrel shaped lower periphery is formed by mating first and second motor shells 62 and 64 which cooperate to define a motor chamber 66. Housed in the motor chamber is a suitable conventional electrical motor 68 of the type having a peripheral fan 70. The motor includes a shaft 72 which is connected to fan blades (not visible) located within a fan case 74 so that as the shaft spins the blades are turned. The fan performs two functions, namely, to draw a suction for the vacuum cleaner and also to cool the motor since the airflow is through the fan case and between the stator and rotor of the motor.

With reference to FIG. 2, the shaft 72 extends out of the motor chamber 66 so that a belt 76 can be looped therearound. The belt otherwise extends in a belt passage 78 formed in the nozzle base 10 so that the belt can also be looped around a suitably conformed section of the brush 14.

With reference again to FIG. 3, the first and second motor shells 62, 64 include respective first end flange portions 82 and 84 which are semi-circular and cooperate to together define a circular stub that rotatably fits in the circular space defined by the chamber first flanged side 30 and the outer shell 33. A lubricating bushing 86 is positioned around the stub formed by the flanges to aid the rotation of the motor and filter housing 60 on the nozzle base 10. The bushing 86 also serves as an air seal.

The cooperating shells 62 and 64 also define a second suction passage 88 which is separated from the motor chamber 66 by a pair of walls 90 and 91. The second suction passage includes a first end 92, which communicates with the first suction passage second end 28, and a second end 94 that extends to an outer periphery 96 of the first motor shell 62. The arrows of FIGS. 1 and 3 illustrate the flow of dirt-laden air through the second suction passage 88.

Provided on the motor shells 62 and 64 are semi-circular second end first and second flanges 98 and 100 respectively. The two flanges 98 and 100 cooperate to form a circular stub. A sleeve 101 is disposed within the circular stub such that it encircles the motor shaft 72 which extends through the stub. The sleeve 101 serves as seal member to seal the motor chamber 66 from the nozzle base 10. A lock ring 103 secures the first and second shell second flanged ends 98 and 100 together with the flanged second side 34 of the nozzle base 10. The flange 34 is semi-circular and the lock ring 103 is so configured as to allow the first and second motor shells to pivot in relation to the nozzle base as the motor and filter housing pivots on the nozzle base. Encircling the flanges 98 and 100, and located inside the flange 34, is a lubricating and sealing bushing 104 to aid the rotational movement of the motor and filter housing 60 on the nozzle base 10 and to provide a seal at that point.

Also provided on the outer periphery 96 of the first motor shell 62 is a top aperture 105. With reference again to FIG. 1, the top aperture 105 communicates with a third suction passage 106 defined by the two motor shells 62 and 64 and spaced between the second suction passage 88 and the motor chamber 66. The third suction passage 106 has an upper end 108 and a lower end 110 which communicates with the motor chamber 66 through an aperture 111. Separating the third suction passage 106 from the second suction passage 88 is the first wall 90 as well as a third wall 112 and a fourth wall 114. Separating the third suction passage 106 from the motor chamber 66 is the second wall 91.

Located on the motor and filter housing 60 in a spaced manner from the first and second motor shells 62 and 64 is a filter bag housing 120. Preferably, the filter bag housing 120 is formed integrally with the second motor shell 64. However, it should also be appreciated that the filter bag housing 120 could be a separate component which is suitably secured to at least one of the first and second motor shells 62 and 64. Defined in the filter bag housing is a suction chamber 122. Positioned in the suction chamber is a suitable filter bag 124 as well as a planar filter member 126 positioned adjacent the third suction passage 106. The filter bag 124 is preferably mounted on a bracket 128 that can be pivotally attached to a wall of the suction chamber 122.

Communicating with an inlet end of the filter bag 124 is an inlet tube 130. The inlet tube 130 has a first end 132 which communicates with the filter bag 124 as well as a second end 134 that is located outside the periphery of the filter bag housing 120. Suitably secured to the inlet tube second end 134 is a hose 140 at its first end 142. A second end 144 of the hose 140 is secured to a tubular adaptor 146.

With reference now to FIG. 4, the adaptor has a first end 148 by which it is rotatably mounted to the hose second end. The adaptor also has an aperture 150 extending through a side wall 152 thereof and communicating with a bore 154 extending therethrough. A collar 156 is rotatably mounted on the adaptor so that the collar can selectively be rotated so as to cover the aperture 150. A second end 158 of the adaptor communicates with a first end 160 of a wand 162. With reference again to FIG. 1, the wand also has a second end 164 which is adapted to selectively extend into the second suction passage second end 94.

If desired the first and second motor shells 62 and 64, the filter bag housing 120, and even the nozzle base 10, can be formed out of a suitable plastic material. However, it should be recognized that one or more of these components could also be formed from a metal such as aluminum or a composite material such as carbon fiber reinforced resin or the like.

The operation of the vacuum cleaner A is as follows. Upon energizing the motor 68, the brush 14 is made to rotate and a suction is drawn in the brush chamber 12 by the fan 70. Dirt-laden air is thus picked up and transported into the first suction passage 24 and through that passage into the second suction passage 88 defined by the cooperating first and second motor shells 62 and 64. The dirt-laden air thereupon travels into the wand 162 and therethrough into the adaptor 146. The air then flows through the adaptor 146 and into the hose 140 and thence into the inlet tube 130. The dirt-laden air then travels into the filter bag 124.

The dirt is trapped in the filter bag 124 and clean air flows out of the bag as indicated by the arrows 166 and into the third suction passage 106 defined by the cooperating motor shells 62 and 64. The clean air is drawn through the fan 70 and flows out a plurality of slots 168 provided in the outer periphery 96 of the first motor shell 162.

When it is desired to use the edge cleaning feature, the first suction passage first end 26 is blocked by rotation of the arm 46 and dirt-laden air is then picked up through the side suction chamber 40 and travels the same path as has been outlined above.

Figure 5:
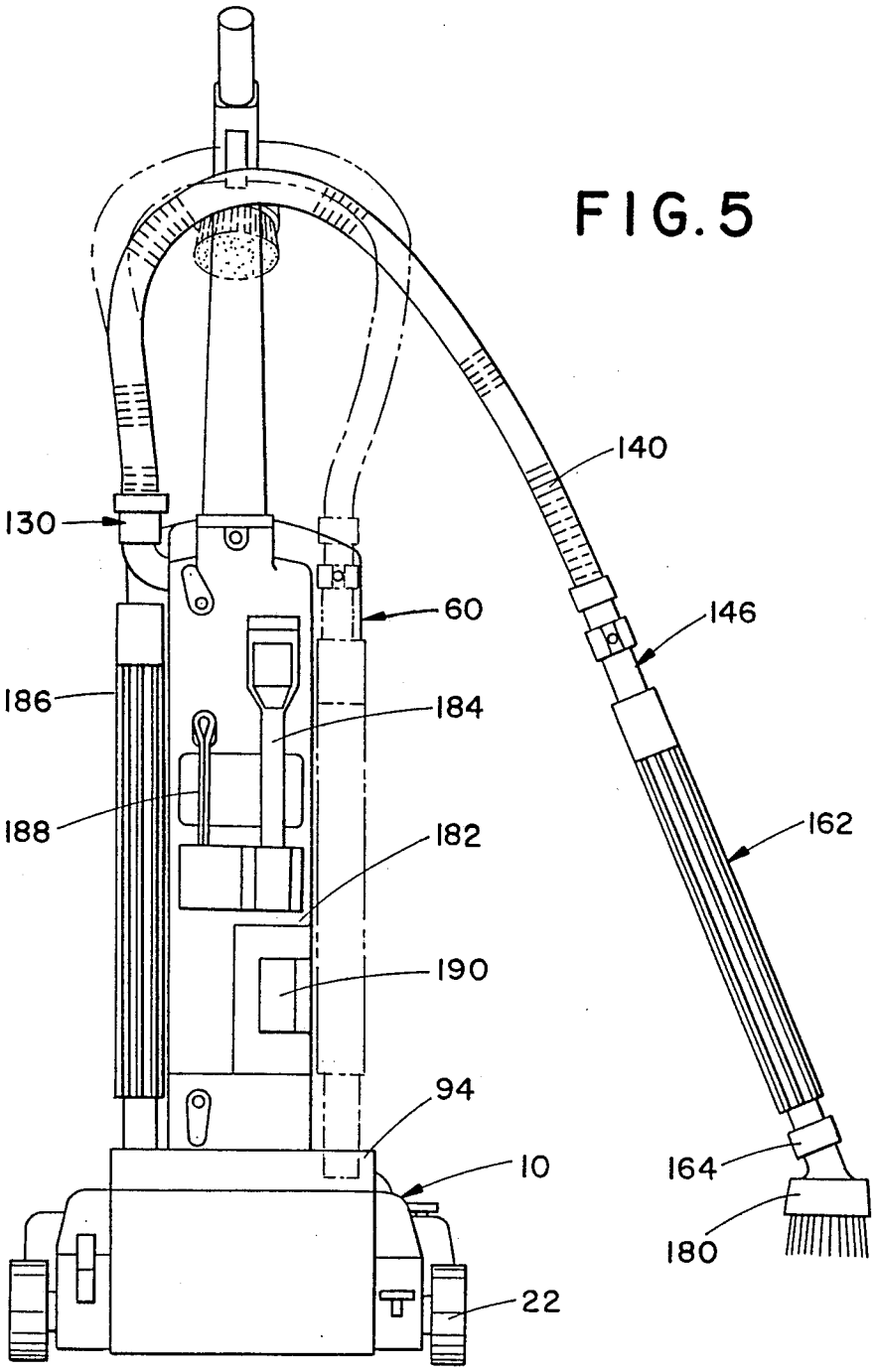

With reference now to FIG. 5, when it is desired to utilize the vacuum cleaner for above the floor cleaning, the wand second end 164 is detached from the second suction passage second end 94 and a suitable cleaning element, e.g., such as a brush 180, is secured to the wand second end 164 in order to enable the vacuum cleaner to be used for the above the floor cleaning operation. When this happens, a suction is drawn on a brush 180 and air then travels through the wand !62 to the adaptor 146 and into the hose 140. The air then travels through the hose and through the inlet tube 130 into the filter bag 124. Again, dirt is trapped in the filter bag and clean air then travels through the third suction passage 106 through the fan 70 and out the slots 168 provided in the first motor shell 62.

The collar 156 would be used during off the floor cleaning by opening the aperture 150 in order to decrease the suction drawn when cleaning, e.g. curtains or the like.

The motor and filter housing 60 has a rear surface 182 which is suitably configured as to hold additional nozzles as at 184, an extra wand 186, a spare belt 188, and spare filter bags 190.

The invention has been described with reference to a preferred embodiment. Obviously, modifications and alterations will occur to others upon the reading and understanding of this specification. It is intended to include all such modifications and alterations in so far as they come within the scope of the appended claims or the equivalents thereof.

What is claimed is:

1. A convertible vacuum cleaner comprising:

a nozzle base movable along a floor surface and including a brush chamber for mounting a rotatable brush and a first suction passage communicating with said brush chamber at one end and with an exterior periphery of said nozzle base at the other end;

a motor and filter housing rotatably mounted on said nozzle base, said housing comprising:

a second suction passage communicating at a first end with said first suction passage second end and at a second end with an exterior periphery of said motor and filter housing, a motor chamber formed in said motor and filter housing in spaced relation to said second suction passage, and a suction chamber disposed in said motor and filter housing in a spaced manner from said second suction passage and said motor chamber, said suction chamber having an inlet port communicating with said exterior periphery of said motor and filter housing; and, a flexible hose mounted on the vacuum cleaner, said hose having a first end, communicating with said second suction passage second end, and a second end communicating with said suction chamber inlet port, wherein said flexible hose first end can be selectively removed from communication with said second suction passage to enable the vacuum cleaner to be used with associated cleaning tools.

2. The vacuum cleaner of claim 1 further comprising a wand having a first end, operatively secured to said hose first end, and a second end secured to said motor and filter housing second suction passage second end.

3. The vacuum cleaner of claim 2 further comprising an adaptor having a first end which is rotatably secured to said hose first end and a second end which is detachably secured to said wand first end.

4. The vacuum cleaner of claim 3 wherein an aperture extends through a side wall of said adapter and further comprising a collar which is rotatably mounted on said adapter to selectively enable communication of said adapter side wall aperture with the environment.

5. The vacuum cleaner of claim 1 further comprising:

an edge cleaning chamber located adjacent said brush chamber in said nozzle base; and, a valve means for selectively communicating said edge cleaning chamber with said first suction passage.

6. The vacuum cleaner of claim 1 further comprising:

a filter bag positioned in said motor and filter housing; and, a planar filter member positioned in said motor and filter housing downstream from said filter bag.

7. The vacuum cleaner of claim 1 further comprising at least one exhaust port provided on said motor and filter housing for exhausting air from said motor chamber.

8. A combination upright and canister type vacuum cleaner comprising:

a nozzle base movable along a floor surface and including a brush chamber for mounting a rotatable brush and a first suction passage communicating with said brush chamber at one end and with an exterior periphery of said nozzle base at the other end;

a motor and filter housing rotatably mounted on said nozzle base, said housing comprising:

a first motor shell, a second motor shell, said first and second motor shells cooperating to define a motor chamber and a second suction passage, which is spaced from said motor chamber to preclude communication therebetween, said second suction passage communicating at a first end with said first suction passage second end and at a second end with an exterior periphery of said motor and filter housing, a motor positioned in said motor chamber, a filter bag housing located adjacent said first and second motor shells and having an exterior periphery, a suction chamber disposed in said filter bag housing, said suction chamber having an inlet port communicating with said exterior periphery of said filter bag housing, a filter bag located in said suction chamber, and a third suction passage defined by said first and second motor shells, said third suction passage communicating at a first end with said suction chamber and at a second end with said motor chamber; and, a tubular conduit communicating said second suction passage second end with said suction chamber inlet port.

9. The vacuum cleaner of claim 8 wherein said tubular conduit comprises:

a wand having a first end, which is selectively secured to said second suction passage second end, and a second end; and, a flexible hose mounted outside said motor and filter housing, said hose having a first end, communicating with said wand second end, and a second end communicating with said suction chamber inlet port, wherein said wand can be selectively disconnected from said suction passage second end to enable the vacuum cleaner to be used with associated cleaning tools.

10. The vacuum cleaner of claim 9 further comprising an adaptor having a first end which is rotatably secured to said hose first end and a second end which is detachably secured to said wand first end.

11. The vacuum cleaner of claim 10 wherein an aperture extends through a side wall of said adapter and further comprising a collar which is rotatably mounted on said adapter to selectively enable communication of said adapter side wall aperture with the environment.

12. The vacuum cleaner of claim 8 further comprising an air filter positioned in said motor and filter housing and serving to separate said suction chamber from said third suction passage of said motor and filter housing.

13. The vacuum cleaner of claim 8 further comprising an inlet tube which is secured to said motor and filter housing, said inlet tube having a first end which communicates with said tubular conduit and a second end which communicates with said filter bag.

14. A convertible vacuum cleaner which can be used both for cleaning a floor surface and for above the floor cleaning operations, comprising:

a nozzle housing movable along a floor surface and including a brush chamber for mounting a rotatable brush and a first suction passage communicating with said brush chamber at one end and with an exterior periphery of said nozzle base at the other end, said nozzle housing further including a substantially semicircular chamber which has on opposed sides thereof first and second flanged sections, respectively;

a motor and filter housing having a substantially barrel shaped lower periphery which is rotatably mounted in said nozzle housing, said motor and filter housing comprising:

a first motor shell having a flanged first end and a flanged second end, a second motor shell having a flanged first end and a flanged second end, said first and second motor shells cooperating to define a motor chamber and a second suction passage, which is spaced from said motor chamber to preclude communication therebetween, said second suction passage communicating, at a first end, with said first suction passage second end and, at a second end, with an exterior periphery of said motor and filter housing, a first means for securing said first and second motor shell flanged first ends to said nozzle housing first flanged section and for providing a first pivot point of said motor and filter housing on said nozzle housing, a second means for securing said first and second motor shell flanged second ends together and providing a second pivot point of said motor and filter housing on said nozzle housing, wherein said second suction passage first end terminates at said first and second motor shell flanged second ends and communicates with said first suction passage second end which is defined in a mating shell portion of said nozzle housing, and a filter bag housing in which is defined a suction chamber, said suction chamber being disposed in a spaced manner from said second suction passage and said motor chamber, said suction chamber having an inlet port communicating with said exterior periphery of said filter bag housing;

a wand having a first end selectively secured to said second suction passage and a second end; and, a flexible hose mounted outside said motor and filter housing, said hose having a first end, communicating with said wand second end, and a second end communicating with said suction chamber inlet port, wherein said wand can be selectively disconnected from said suction passage second end to enable the vacuum cleaner to be used with associated cleaning tools.

15. The vacuum cleaner of claim 14 further comprising an adaptor having a first end which is rotatably secured to said hose first end and a second end which is detachably secured to said wand first end.

16. The vacuum cleaner of claim 15 wherein an aperture extends through a side wall of said adapter and further comprising a collar which is rotatably mounted on said adapter to selectively enable communication of said adapter side wall aperture with the environment.

17. The vacuum cleaner of claim 14 further comprising:

a filter bag secured in said suction chamber: and, a planar filter member positioned in said motor and filter housing and serving to separate said suction chamber from said motor chamber of said motor and filter housing.

18. The vacuum cleaner of claim 17 further comprising a third suction passage defined by said first and second motor shells, said third suction passage extending between said second suction passage and said motor chamber and communicating at one end with said suction chamber and at another end with said motor chamber.

19. The vacuum cleaner of claim 14 further comprising:

a motor shaft which extends out of said motor housing;

a belt which is looped around said motor shaft; and, a belt passage formed in said nozzle housing outside of said substantially semicircular chamber for accommodating said belt, said belt also being looped around said rotatable brush.

20. The vacuum cleaner of claim 14 further comprising:

an edge cleaning chamber located adjacent said brush chamber in said nozzle base; and, a valve means for selectively communicating said edge cleaning chamber with said first suction passage.

* * * * *